US011005176B2

(12) United States Patent
Iluz et al.

(10) Patent No.: US 11,005,176 B2
(45) Date of Patent: May 11, 2021

(54) RADOME SHELL HAVING A NON-UNIFORM STRUCTURE

(71) Applicant: WISENSE TECHNOLOGIES LTD., Tel Aviv (IL)

(72) Inventors: Zeev Iluz, Gan-Yavne (IL); Moshik Moshe Cohen, Or Yehuda (IL)

(73) Assignee: WISENSE TECHNOLOGIES LTD, Tel Aviv (IL)

( * ) Notice: Subject to any disclaimer, the term of this patent is extended or adjusted under 35 U.S.C. 154(b) by 13 days.

(21) Appl. No.: 16/423,013

(22) Filed: May 26, 2019

(65) Prior Publication Data

US 2020/0373658 A1 Nov. 26, 2020

(51) Int. Cl.

| | |
|---|---|
| ***H01Q 1/42*** | (2006.01) |
| ***H01Q 1/52*** | (2006.01) |
| ***H01Q 1/40*** | (2006.01) |

(52) U.S. Cl.

CPC ..... *H01Q 1/526* (2013.01); *H01Q 1/405* (2013.01); *H01Q 1/42* (2013.01)

(58) Field of Classification Search

CPC ..... H01Q 1/40; H01Q 1/405; H01Q 1/42; H01Q 1/422; H01Q 1/526

See application file for complete search history.

(56) References Cited

U.S. PATENT DOCUMENTS

| | | | | |
|---|---|---|---|---|
| 5,182,155 | A | 1/1993 | Roe et al. | |
| 5,389,943 | A | 2/1995 | Brommer et al. | |
| 2008/0088510 | A1* | 4/2008 | Murata | H01Q 19/28 343/700 MS |
| 2009/0167628 | A1* | 7/2009 | Frenkel | H01Q 21/002 343/872 |
| 2013/0009846 | A1 | 1/2013 | Freitag et al. | |
| 2015/0222011 | A1 | 8/2015 | Kolak et al. | |

FOREIGN PATENT DOCUMENTS

| | | |
|---|---|---|
| SU | 985981 | 12/1982 |

OTHER PUBLICATIONS

International Search Report for Application No. PCT/IL2020/050575, dated Sep. 6, 2020.

* cited by examiner

*Primary Examiner* — Jimmy T Vu

(74) *Attorney, Agent, or Firm* — Pearl Cohen Zedek Latzer Baratz LLP

(57) ABSTRACT

A radome shell for shielding a radio-frequency (RF) antenna, the radome shell comprising one or more layers of dielectric material. At least one layer comprises a plurality of repetitive gaps, and at least one of width, length and depth of the repetitive gaps is of an order of magnitude of a working frequency wavelength of the RF antenna or one order of magnitude smaller than the working frequency wavelength of the RF antenna.

19 Claims, 8 Drawing Sheets

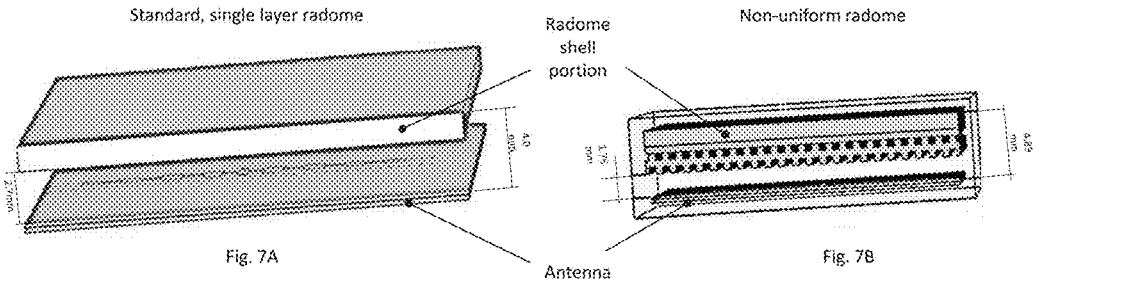
Fig. 7A
Fig. 7B
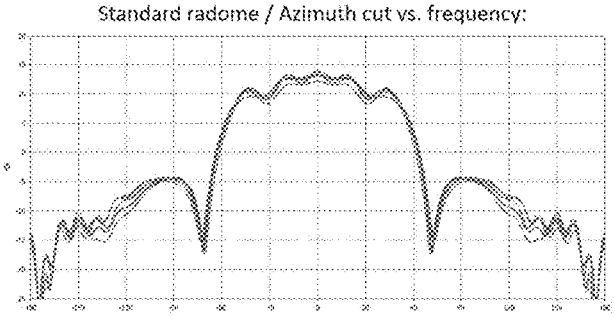
Fig. 8A
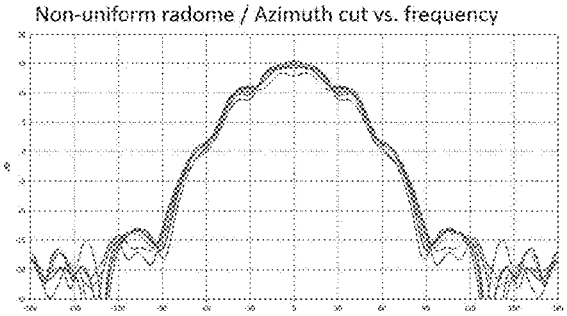
Fig. 8B

RADOME SHELL HAVING A NON-UNIFORM STRUCTURE

FIELD OF THE INVENTION

The present invention relates generally to systems for transmission and reception of electronic signals. More specifically, the present invention relates to antennae radome shells having a non-uniform structure.

BACKGROUND OF THE INVENTION

As known in the art, a radome is a protective cover, designed to shield an antenna (e.g., a radar or communications transceiver antenna) from harmful effects of its surrounding environment, with minimal impact to the electrical performance of the antenna. Under ideal conditions, a radome shell or wall should be electrically invisible. In order to achieve such quality, proper design of a radome shell should match the radome configuration and materials composition to a particular application and radio-frequency (RF) range. In effect, a tradeoff exists between the radome's transparency and its physical qualities, including the rigidity of the radome's structure and the protection it provides to the antenna.

One type of a commercially available radome shell structure is referred in the art as "electrically thin". Such a structure may include a thin dielectric layer shielding the antenna. The dielectric layer may herein be referred to as 'thin' in relation to a typical wavelength of the application's RF frequency range. For example, an electrically thin layer may be in the order of 0.1 of the working RF wavelength. Electrically thin layers typically provide good RF performance (e.g., a low RF reflection coefficient), because signal reflections at the free-space/dielectric boundary are cancelled-out by out-of-phase reflections from the dielectric/free space boundary on the other side of the dielectric material. However, electrically thin layers may provide poor thermal isolation and inferior structural rigidity, especially in high-frequency (short wavelength) applications.

A second type of a commercially available radome shell structure is referred in the art as a "half-wavelength-thick" structure, in which the thickness of the shielding layer is set to be half the working RF wavelength (or an integer product thereof). This structure provides electrical properties that are similar to the electrically thin configuration because round-trip reflections of the RF signals between the borders of the shielding layer cancel-out.

However, optimal RF performance normally dictates that the width of the shielding layer is kept at a minimal width (e.g., a single half-wavelength) due to considerations of RF signal dispersion within the layer and due to considerations of non-tangent transmission/reception of the RF signal (e.g., when not using a concentric, round radome-antenna structure). Consequently, as in the case of an electrically thin layer, the shielding properties of half-wavelength-thick are diminished in high-frequency (short wavelength) applications.

A third type of a commercially available radome shell structure is referred in the art as a "sandwich" structure, in which a low-dielectric foam layer is sandwiched between two thin dielectric skin layers. In order to minimize RF reflection through the radome shell, this approach typically dictates the width of the foam layer to be ¼ of the working RF wavelength, and the width of the skins to be even thinner Consequently, this approach suffers the same disadvantages of structural instability, especially in high-frequency (short wavelength) applications, as elaborated herein in relation to the thin-layer and half-wavelength approaches.

SUMMARY OF THE INVENTION

State of the art radomes, e.g., in the automotive industry, typically include radomes that may be produced as a continuous sheet of material, such as Teflon or Polytetrafluoroethylene (PTFE), do not enable a tradeoff between electromagnetic properties and physical (e.g., rigidity) properties of the radome, are limited in their capability to provide protection to the antenna, especially in adverse speed and weather conditions, and cannot be used for optimization of the antenna's radiation pattern.

An antenna radome that may provide structural rigidity and thermal isolation while maintaining a high transparency (e.g., having a low RF reflection coefficient) is therefore desired. Embodiments of the present invention provide a radome shell, and a method of manufacturing thereof, that may facilitate optimal selection of radome parameters, to obtain a "sweet spot" in the tradeoff between the radome shell's transparency and its physical qualities, such as the rigidity of the radome's structure and the protection it provides to the antenna.

Embodiments of the present invention may include a radome shell for shielding a radio-frequency (RF) antenna. The radome shell may include one or more layers of dielectric material, where at least one layer may include a plurality of repetitive gaps.

At least one of size (e.g., width, length and/or depth) of the repetitive gaps may be of an order of magnitude of a working frequency wavelength of the RF antenna when propagating through the dielectric material. For example, the at least one size may be between 0.1 of the working RF wavelength and the working RF wavelength. Alternately or additionally, at least one of size (e.g., width, length and/or depth) of the repetitive gaps may be of an order of magnitude smaller than the working frequency wavelength of the RF antenna when propagating through the dielectric material. For example, the at least one size may be between 0.01 of the working RF wavelength and 0.1 of the working RF wavelength.

According to some embodiments, one or more layers may include a plurality of layers, where at least one a first layer of dielectric material may be a gapped layer that may include a plurality of repetitive gaps, and where at least a second layer of dielectric material may be a gapless layer (e.g., a uniform layer of dielectric material).

The depth of the repetitive gaps and the thickness of the gapless layer may be set so that when in use with the antenna (e.g., when RF energy of the antenna's working frequency is transferred through the radome), a cross-section of the radome shell in a direction of the antenna's transmission or reception may include a section of dielectric material that has a width substantially equal to an integer product of an equivalent half wavelength of the antenna's RF working frequency.

The term equivalent half wavelength (EHW) may be used herein to refer to a length of propagation of RF radiation, at a working frequency of the RF antenna, through a composite segment of a radome shell. The composite segment may include one or more materials, such as a first material (e.g., plastic), having a first dielectric coefficient and a second material (e.g., air) having a second dielectric coefficient that may be different from the first dielectric coefficient. EHW is termed 'equivalent' in a sense that the effect of propagation or transfer of the RF radiation through the composite segment, along a path of length EHW, on the phase of the RF radiation (e.g., a 180 degree shift) may be equivalent to the effect of propagation of the RF radiation along a path of half a wavelength of the RF radiation through a uniform (e.g., non-composite) media or material having a single dielectric coefficient.

At least one gap parameter value (e.g., width, length, depth, orientation and spatial frequency) of the repetitive gaps of the radome shell of the present invention may be determined based on at least one of the amount and distribution of dielectric material in the radome shell. This determination may be done, as elaborated herein, so that the radome shell of the present invention may have a higher rigidity coefficient than a second radome shell having the same size and shape as the radome shell of the present invention, where (a) the second radome may include a single, gapless layer of the same dielectric material as the dielectric material forming the radome shell of the present invention, and (b) the single gapless layer of the second radome shell has a thickness equal to half the wavelength of the antenna's RF working frequency.

At least one gap parameter value (e.g., width, length, depth and spatial frequency) of the repetitive gaps of the radome shell of the present invention may be set according to the antenna's RF working frequency, so that the transparency coefficient of the radome shell of the present invention at the antenna's RF working frequency and at the direction of the antenna's reception or transmission may be substantially equal to or higher than the transparency coefficient of the second radome shell.

At least one gap parameter value (e.g., width and length) of the repetitive gaps may be set according to the antenna's working RF frequency, so that the specificity of the radome shell of the present invention to the antenna's working RF frequency may be higher than the specificity of the second radome shell to the antenna's working RF frequency. The term 'specificity' may be used herein in the context of a specific, first RF frequency to refer to a relation (e.g. in db) between a first transparency coefficient of RF energy in the first (e.g., desired) RF frequency and a second transparency coefficient of RF energy in a second (e.g., undesired) RF frequency.

At least one gap parameter value (e.g., width, length and spatial frequency) of the repetitive gaps may be set according to the antenna's working RF frequency, so that the specificity of the radome shell of the present invention to the direction of the RF energy may be higher than the specificity of the second radome shell to the direction of the RF energy. The term 'specificity' may be used herein in the context of a specific, first direction to refer to a relation (e.g. in db) between a first transparency coefficient of RF energy in the first (e.g., desired) direction and a second transparency coefficient of RF energy in a second (e.g., undesired) direction.

The orientation of the repetitive gaps may be set according to a polarization of RF energy, so that the specificity of the radome shell of the present invention to the RF energy polarization may be higher than the specificity of the second radome shell to the RF energy polarization. The term 'specificity' may be used herein in the context of a specific, first polarization to refer to a relation (e.g. in db) between a first transparency coefficient of RF energy in the first (e.g., desired) polarization and a second transparency coefficient of RF energy in a second (e.g., undesired) polarization.

The radome shell of the present invention may be associated with a requirement (e.g., by a designer of the radome shell) for a minimal physical rigidity coefficient. At least one parameter value of the repetitive gaps may be set so as to accommodate the requirement of the minimal physical rigidity coefficient. The at least one parameter may be selected from a list including: a width, a length and a depth of the repetitive gaps, an orientation of the repetitive gaps and a spatial frequency of the repetitive gaps.

The radome shell of the present invention may be associated with at least one of:

- a first transparency requirement for a minimal transparency coefficient, relating to a first RF frequency; and
- a second transparency requirement for a maximal transparency coefficient, relating to a second RF frequency.

At least one of the width, length and spatial frequency of the repetitive gaps may be set to accommodate at least one of the first transparency requirement and second transparency requirement, as elaborated herein.

The radome shell of the present invention may be associated with at least one of:

- a first transparency requirement for a minimal transparency coefficient relating to a first portion of the radome shell;
- a second transparency requirement for a minimal transparency coefficient relating to a second portion of the radome shell;
- a third transparency requirement for a maximal transparency coefficient relating to a third portion of the radome shell; and
- a fourth transparency requirement for a maximal transparency coefficient relating to a fourth portion of the radome shell.

At least one of the width, length and spatial frequency of the repetitive gaps may be set to accommodate at least one of the first, second, third and fourth transparency requirements, as elaborated herein.

The radome shell of the present invention may be associated with at least one of:

- a first polarity requirement for a minimal transparency coefficient relating to a first polarity of RF energy; and
- a second polarity requirement for a maximal transparency coefficient relating to a second polarity of RF energy.

The orientation of the repetitive gaps may be set to accommodate at least one of the first polarity requirement and second polarity requirement, as elaborated herein.

The radome shell of the present invention may be associated with at least one of:

- a first polarity requirement for a minimal transparency coefficient relating to a first polarity of RF energy and to a first portion of the radome shell;
- a second polarity requirement for a maximal transparency coefficient relating to a second polarity of RF energy and to the first portion of the radome shell
- a third polarity requirement for a minimal transparency coefficient relating to a second polarity of RF energy and to a second portion of the radome shell; and
- a fourth polarity requirement for a maximal transparency coefficient relating to the second polarity of RF energy and to the second portion of the radome shell.

The orientation of the repetitive gaps may be set to accommodate at least one of the first, second, third and fourth polarity requirements, as elaborated herein.

According to some embodiments, the gapless layer may include one or more first section of a first material, having a first dielectric coefficient, and one or more second sections of a second material, having a second dielectric coefficient.

According to some embodiments, the radome shell of the present invention may include two or more layers of dielectric material and the two or more layers may have different dielectric coefficients. Alternately, or additionally, The radome shell of the present invention may include at least one layer that may include two or more dielectric materials, having respective two or more different dielectric coefficients.

According to some embodiments, the radome shell of the present invention may include two or more layers of dielectric material, having a plurality of repetitive gaps. The two or more layers may have at least one different parameter value of repetitive gaps. The at least one parameter value may be selected from a list including: a width of the repetitive gaps, a length of the repetitive gaps, a depth of the repetitive gaps, a spatial frequency of the repetitive gaps and an orientation of the repetitive gaps.

According to some embodiments, at least one dielectric layer may include two or more sections of repetitive gaps, having at least one different local parameter of repetitive gaps, selected from a list consisting of: a width of the repetitive gaps, a length of the repetitive gaps, a depth of the repetitive gaps, a spatial frequency of the repetitive gaps and an orientation of the repetitive gaps.

Embodiments of the present invention may include method of manufacturing a radome shell for shielding an RF antenna. The method may include producing a first layer of dielectric material and layering (e.g., by three-dimensional printing) one or more second layers of dielectric material over the first layer, to form the radome shell. At least one of the first layer and one or more second layers may include a plurality of repetitive gaps. At least one dimension of the gaps may be of an order of magnitude of a working frequency wavelength of the RF antenna or one order of magnitude smaller than the working frequency wavelength of the RF antenna, as elaborated herein.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

FIGS. 7A and 7B are isometric diagrams, respectively depicting a standard, one-layer radome portion, as known in the art and a non-uniform radome portion that may be included in an embodiment of the present invention; and FIGS. 8A and 8B are data plots of experimental measurements, depicting the received RF power that was measure as a function an antenna's working RF frequency and orientation, respectively relating to a standard, one-layer radome portion, as known in the art and a non-uniform radome portion that may be included in an embodiment of the present invention.

Figure 1B:
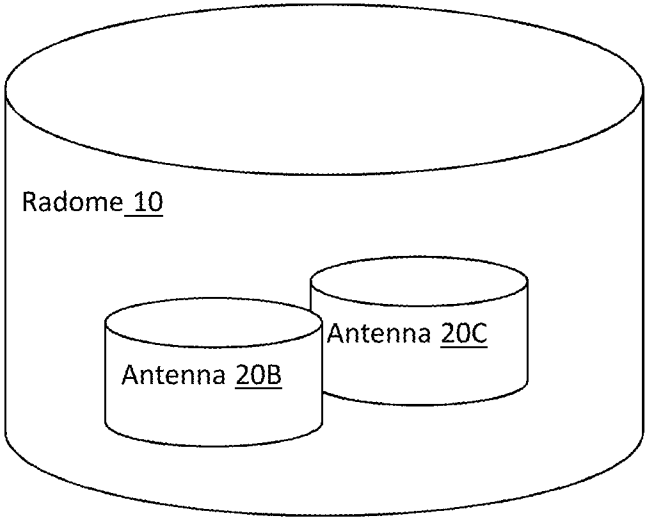
FIGS. 1A and 1B are schematic diagrams, respectively depicting a structure of a radome-shielded antenna in a concentric configuration, and in a non-concentric configuration, as known in the art.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention. Some features or elements described with respect to one embodiment may be combined with features or elements described with respect to other embodiments. For the sake of clarity, discussion of same or similar features or elements may not be repeated.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. The term set when used herein may include one or more items. Unless explicitly stated, the method embodiments described herein are not constrained to a particular order or sequence. Additionally, some of the described method embodiments or elements thereof can occur or be performed simultaneously, at the same point in time, or concurrently.

Embodiments of the present invention may include a radome shell, having a non-uniform structure, configured to accommodate at least one radome requirement, and a method of manufacturing thereof.

The following table may serve as a reference to terms that may be used herein

| | |
|---|---|
| Radome property | The term radome property or radome properties may be used herein to refer to one or more qualities or characteristics of a radome shell, including for example:<br>a structural rigidity of the radome shell;<br>a thermal isolation provided by the radome shell;<br>a transparency of the radome shell to RF energy (e.g., a percentage of received and/or transmitted RF energy that may permeate the radome shell); |

-continued

| | |
|---|---|
| | a dispersion of the radome shell (e.g., a percentage of received and/or transmitted RF energy that may be dispersed by a non-homogeneity in the radome shell); and<br>a reflection of the radome shell (e.g., a percentage of received and/or transmitted RF energy that may be reflected by the radome shell). |
| Radome requirement | The term radome requirement may be used herein to refer to one or more requirements for the design or physical properties of a radome shell. For example, such requirements may be made by a designer of a radome shell, and may be applied to a radome property of the radome shell. Such requirements may include for example:<br>a requirement for a minimal structural rigidity coefficient value and/or thermal isolation parameter value;<br>a maximal percentage or coefficient value of RF energy dispersion;<br>a minimal percentage or coefficient value of RF transparency;<br>a maximal percentage or coefficient value of RF reflection, and the like. |
| Transparency, reflection and dispersion | The terms transparency, reflection and dispersion may be used herein to refer to respective physical qualities of material (e.g., dielectric material that may be included in a radome shell of the present invention) in relation to RF energy (e.g., RF energy transparency, RF energy reflection and RF energy dispersion). |
| Radome parameter | The term radome parameter may be used herein to refer to one or more parameters, descriptions, or dimensions of the radome that may be set or selected to obtain or accommodate at least one radome requirement. The radome parameter may include, for example:<br>a dielectric material, from which may be included in at least one portion or layer of the radome shell;<br>a number of layers that the radome shell may include;<br>an ordering or placement of two or more layers in the radome shell, and the like. |
| Gap parameter | The term gap parameter may be used herein to refer to one or more characteristics of a gap in a radome shell or a part or layer thereof that may be set or selected to obtain or accommodate at least one radome requirement. Gap parameters may include for example: a dimension (e.g., length, width and depth) of a gap, a spatial frequency (e.g., a frequency of spatial repetition) of a gap and an orientation (e.g., along a spatial vector or axis) of a gap. |

Figure 1A:
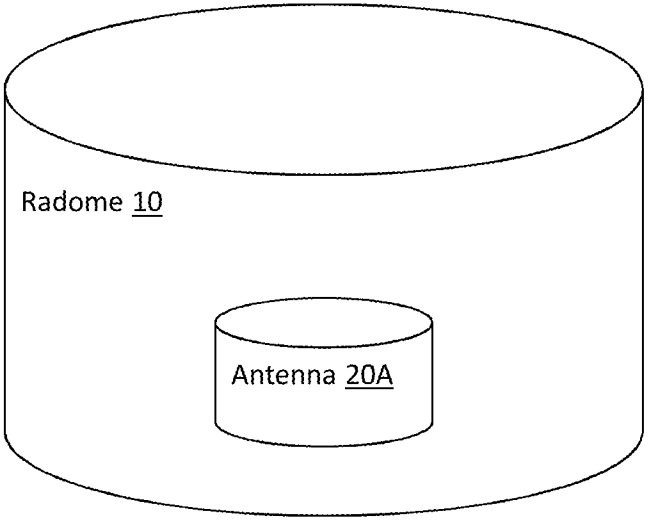

Reference is now made to FIGS. 1A and 1B respectively depicting a structure of a radome-shielded antenna in a concentric configuration, and in a non-concentric configuration, as known in the art.

As shown in FIGS. 1A and 1B, a radome 10 may be configured to cover or shield an electromagnetic radio-frequency (RF) transmission and/or reception system, that may include an antenna 20 (e.g., 20A, 20B and 20C), as known in the art.

In some embodiments, radome 10 and antenna 20 (e.g., antenna 20A) may be substantially coaxially aligned in a concentric configuration, as depicted in FIG. 1A. For example, antenna 20A may be included in a radar system, and may be configured to both transmit RF energy and receive reflections of the transmitted RF energy, to produce a radar image, as known in the art.

In additional embodiments, radome 10 and one or more antennae 20 may be included in a non-concentric configuration, as depicted in FIG. 1B, where radome 10 and the one or more antennae 20 (e.g., antennae 20B and 20C) may not be coaxially aligned. For example, antennae 20B and 20C may be included in a communication system that may be configured to transmit RF energy having a first frequency via a first antenna (e.g., 20B), and receive RF energy having a second frequency via a second antenna (e.g., 20C).

Embodiments of the invention may include a radome that may include a shell, that may be customized to accommodate specific radome requirements. The radome requirements may pertain specific radome properties and may apply to concentric and/or non-concentric configurations of antenna-radome structures, as elaborated herein.

Figure 2:
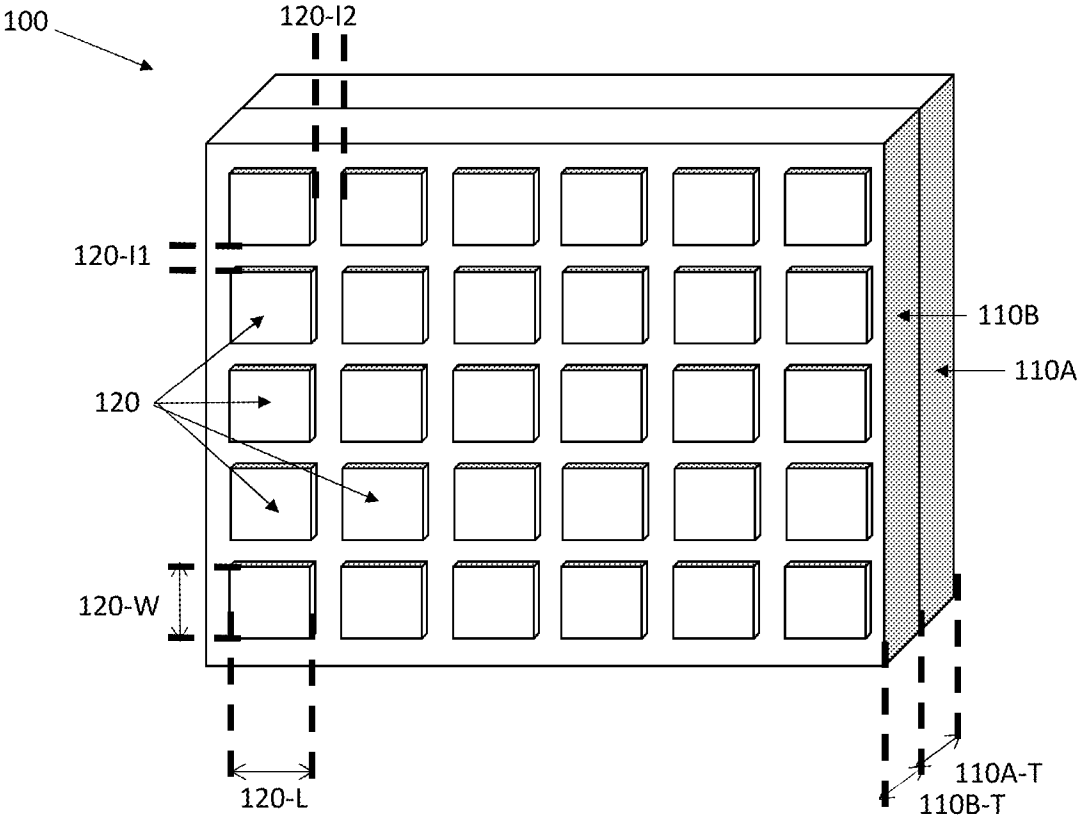
FIG. 2 is a diagram depicting a portion of a radome shell, having a non-uniform structure according to some embodiments of the invention.

Reference is now made to FIG. 2, which depicts a portion of a radome shell 100 or wall for shielding a radio-frequency (RF) antenna. The radome shell 100 may have a non-uniform structure according to some embodiments of the invention. The shell structure may be non-uniform in a sense that: (a) it may include a plurality of layers that may differ, for example, in structure and/or material, as explained herein (b) one or more layers may include a plurality of gaps in their structure, as elaborated herein and (c) one or more layers may include a plurality of locations that may differ for example, in structure and/or material, as explained herein.

As shown in FIG. 2, the radome shell 100 may include one or more layers 110 (e.g., 110A, 110B) of dielectric matter or material. According to some embodiments, radome shell 100 may include at least one first layer of a first dielectric material and at least one second layer of a second dielectric material, where the dielectric coefficient of the first dielectric material may be different from the dielectric coefficient of the second dielectric material.

According to some embodiments, at least one layer 110 may include two or more dielectric materials, having respective two or more different dielectric coefficients (e.g., at different portions or locations of the layer).

The one or more layers 110 may have a non-uniform structure. For example, at least one layer 110 may include at least one first portion of a solid dielectric material (having a dielectric coefficient of the solid material) and at least one second portion of a hole or gap 120 where there is an absence of dielectric material (having a dielectric coefficient of air).

In another example, at least one layer 110 may include at least one first portion of a first solid dielectric material (having a dielectric coefficient of the first solid material) and at least one second portion of a second solid dielectric material (having a dielectric coefficient of the second solid material).

In another example, layers 110 may include a plurality of gaps or openings 120 (e.g. air gaps) that may be adapted to influence properties of the radome (e.g., radome properties), including for example the transparency of radome shell 100 to RF energy at a working frequency of an antenna (e.g., antenna 20 of FIG. 1) and the rigidity of the radome structure, as explained herein.

In some embodiments, at least one gap 120 may be formed as a complete opening or hole through the entire thickness or depth of one or more layers 110. For example, at least one gap may run through the thickness of layer 110A (e.g., 110A-T) and/or through the thickness of layer 110B (e.g., 110B-T). Additionally, or alternately, at least one gap may be formed as a partial recess through a portion of the thickness or depth of a layer. For example, at least one gap 120 may be formed as a recess in layer 110B, where the extent or depth of the recess of gap 120 may be smaller (e.g., shallower) than the thickness of layer 110B (e.g., 110B-T).

In some embodiments, the plurality of gaps 120 may be repetitive, in a sense that they may appear in a preset spatial position on the radome shell 100. For example, the plurality of gaps 120 may be implemented as a set of holes, having a preset dimension (e.g., a length a width and/or a depth), may have a preset orientation (e.g., along a spatial axis, and/or in one or more rows) and may be located at a preset spatial frequency or interval (e.g., 120-I1, 120-I2) on radome shell 100.

It is to be noted that dimensions of the gaps 120 may not be related to dimensions of gaps that may be inherent in the dielectric material (e.g., gaps within a molecular structure of the dielectric material). In some embodiments, the plurality of repetitive gaps 120 may have at least one dimension (e.g., a length 120-L and/or a width 120-W) that may be substantially in the same order of magnitude or one order of magnitude smaller than a working frequency wavelength of the RF antenna, e.g., between 0.1 of the working wavelength and the working wavelength. For example, for a working frequency of 20 Gigahertz (having a wavelength of approximately 1.5 centimeters), a repetitive gap may have at least one dimension (e.g., a length 120-L and/or a width 120-W) that may be between 1.5 millimeters and 1.5 centimeters.

Reference is now made to FIGS. 3A, 3B, 3C and 3D which depict a comparative, cross section upper view of four different example implementations for a radome shell 100 (e.g., 100A, 100B, 100C and 100D). Other implementations may be used.

As known in the art, (a) the speed of propagation of RF radiation through media or material may be dictated by the dielectric coefficient of the respective media or material, and (b) the wavelength of RF radiation linearly relates to the speed of propagation (according to the equation $V=\lambda \cdot f$, where V is the speed of propagation, f is the RF frequency and $\lambda$ is the wavelength). Subsequently, the wavelength of RF radiation may also be dictated by the dielectric coefficient of the media or material (e.g., as the dielectric coefficient is increased, $\lambda$ is decreased).

Figure 3B:
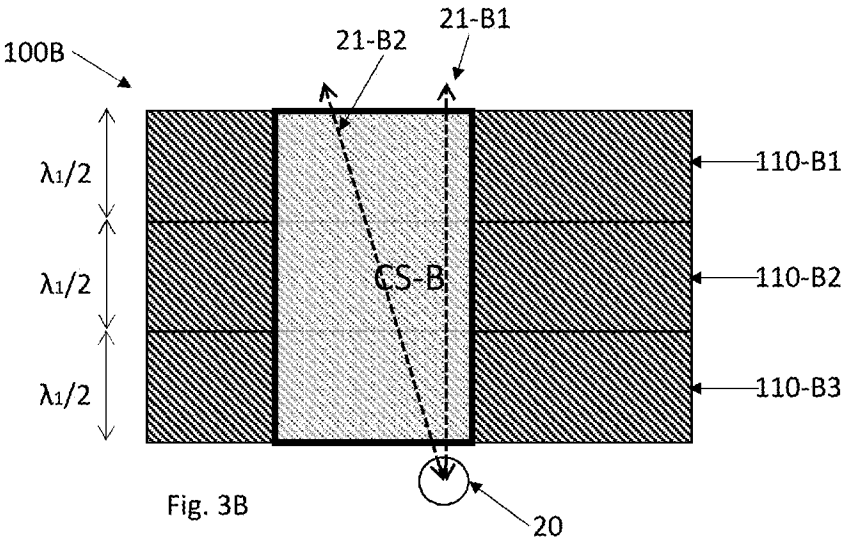
FIGS. 3A, 3B, 3C, 3D and 3E are schematic cross section, upper views of five different implementations for a radome shell that may be included in the some embodiments of the invention.
Figure 3A:
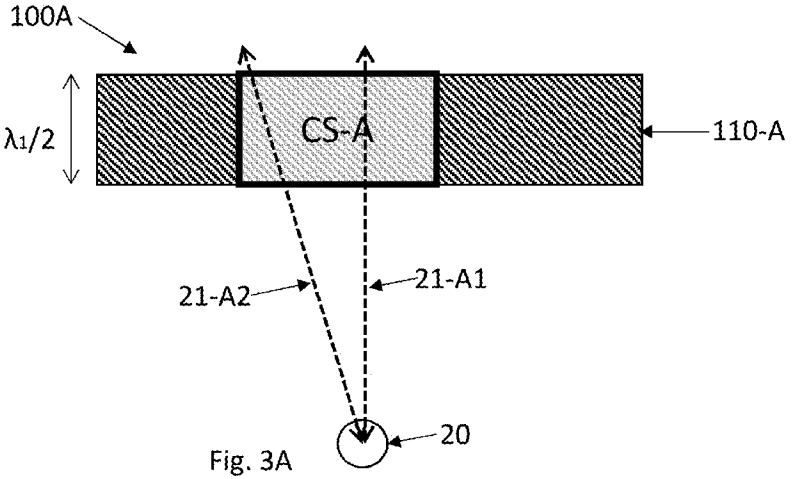

FIGS. 3A and 3B depict a schematic view of a commercially available "half-wavelength-thick" radome shell structure, where each layer (e.g., 110-A, 110-B1, 110-B2, 110-B3) of a dielectric material may have a width of half the working RF wavelength (marked $\lambda_1/2$) of the antenna within. According to some embodiments, a radome shell of the present invention may be or may include at least one portion that may be implemented as one or more gapless layer dielectric material, as depicted in the examples of FIGS. 3A and 3B.

As explained herein, a half-wavelength-thick structure may be characterized by a thickness of the shielding which may be set to be half the working RF wavelength, as shown in FIG. 3A or an integer product thereof (e.g., 1.5 $\lambda_1$), as depicted in FIG. 3B. As known in the art, commercially available half-wavelength-thick structures provide electrical properties that are similar to electrically thin radome configurations because round-trip reflections of the RF signals between the borders of the shielding layer cancel out.

As explained herein, optimal RF performance may dictate that the width of the shielding layer is kept at a minimal width (e.g., a single half-wavelength), as depicted in FIG. 3A due to considerations of RF signal dispersion within the layer and due to considerations of non-tangent transmission and/or reception of the RF signal (e.g., when not using a concentric, round radome-antenna structure). This is demonstrated by comparing lines 21-A2 and 21-B2: as known in the art, a radome shell structure (e.g., 100B) having a triple half-wavelength width (e.g., along radiation line 21-B2 in FIG. 3B) may have a lower transparency coefficient of RF energy at wavelength $\lambda$ than a radome shell structure (e.g., 100A) having a single half-wavelength width (e.g., along radiation line 21-A2). However, shielding properties (e.g., resilience to wind, quality of thermal insulation, rigidity of structure, etc.) of the thinner, single half-wavelength width implementation (e.g., 100A) are diminished in comparison to those of the triple half-wavelength width implementation (e.g., 100B). This may be particularly relevant in high-frequency (e.g., short wavelength) applications.

Figure 3C:
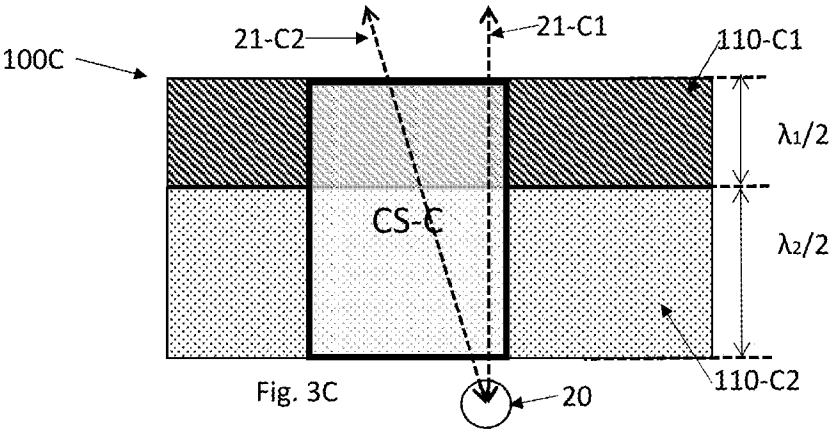

Reference is now made to FIG. 3C, depicting a radome shell implementation (e.g., 100C) that may include one or more (e.g., two) layers of dielectric material (110-C1, 110-C2). For example, layer 110-C1 may be a gapless layer of dielectric material and layer 110-C2 may be a gapped layer of dielectric material, including a plurality of repetitive gaps as described herein.

As explained herein, one or more gap parameters (e.g., width, length, depth and spatial frequency of the gaps) may be one order of magnitude smaller than the working frequency wavelength of the antenna. For example, the repetitive structure of gaps and dielectric material may be viewed as a repetition of elementary units, where each unit includes a dielectric material portion and a gap portion, and where each elementary unit may be in one order of magnitude smaller than the working wavelength (e.g., $\lambda_1/10$).

As known in the art, due to the small scale of the elementary units (e.g., 1/10 of the working wavelength), the combined structure of a first dielectric material having a first dielectric coefficient and repetitive gaps may be viewed as equivalent to a spatially uniform, second dielectric material having a second dielectric coefficient.

The second dielectric coefficient may have an equivalent value that may be a function of the first dielectric coefficient, the dielectric coefficient of the gaps (e.g., of air) and the relative geometry (e.g., volume) of the first dielectric material and the gaps within the elementary units. Accordingly, the equivalent half-wavelength (EHW) of the second dielectric material may have a second value (marked $\lambda_2/2$) that may be a function of the first dielectric coefficient, the dielectric coefficient of the gaps (e.g., of air) and the relative geometry (e.g., a ratio of volumes) of the first dielectric material and the gaps within the elementary units.

In the example depicted in FIG. 3C, as the gaps are increased in size within the elementary units of gapped layer 110-C2, the equivalent second dielectric coefficient may decrease, the speed of RF propagation through the equivalent second dielectric material may increase, and the equivalent second half-wavelength EHW ($\lambda_2/2$) of gapped layer 110-C2 may increase.

Similarly, the transparency coefficient of gapped layer 110-C2 may be a function of the working frequency, the geometry (e.g., width) of gapped layer 110-C2 and of the relation between gap portions and dielectric material portions at each elementary unit.

According to some embodiments, at least one gap parameter (e.g., depth of the repetitive gaps) of gapped layer 110-C2 and the thickness of the gapless layer 110-C1 are set so that when the shell is in use (e.g., when the radome shell is installed to shield antenna 20 as known in the art), a cross-section (e.g., CS-C) in a direction of the antenna's transmission or reception (e.g., 21-C1) may include a section of dielectric material that has a width substantially equal to an integer product of an equivalent half wavelength (EHW) of the antenna's RF working frequency.

For example, as depicted in FIG. 3C, RF radiation or energy propagating through the radome shell may pass through two equivalent half wavelengths: $\lambda_1/2$ and $\lambda_2/2$.

The term 'equivalent' in the context of half wavelengths (e.g., $\lambda_1/2$ and $\lambda_2/2$) may be used herein to indicate that even though $\lambda_1/2$ and $\lambda_2/2$ may differ in actual length, they may represent an equivalent effect of propagation of the RF radiation through a respective media (e.g., through layers 110-C1, 110-C2 respectively) in terms of the RF radiation phase.

Figure 3E:
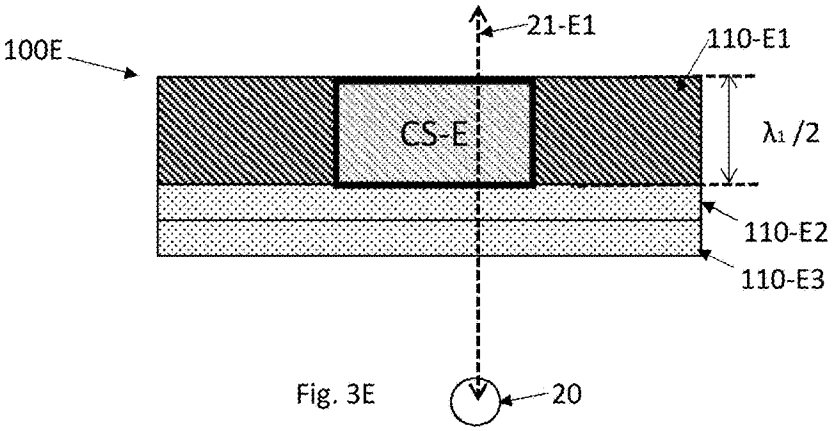
Figure 3D:
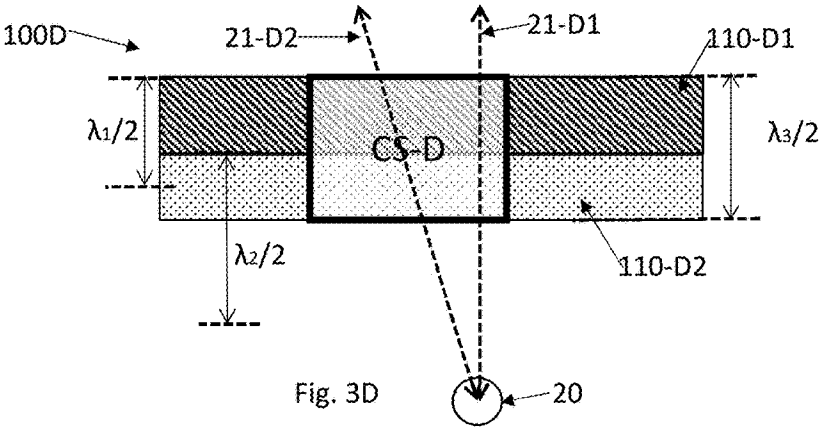

For example, as shown in FIG. 3D, the radome shell implementation (e.g., 100D) may include one or more (e.g., two) layers of dielectric material (e.g., 110-D1, 110-D2), where a first layer (e.g., 110-D1) may be gapless (e.g., impenetrable to water), and at least one second layer (e.g., 110-D2) may be non-uniform (e.g., have repetitive gaps therein). As depicted in FIG. 3D, each layer of dielectric material (e.g., 110-D1, 110-D2) may have a width that may be different (e.g., less) than the half-wavelength width. For example, layer 110-D1 may be thinner than $\lambda_1/2$ and layer 110-D2 may be thinner than $\lambda_2/2$.

At least one gap parameter (e.g., depth of the repetitive gaps) of the one or more gapped layers (e.g., 110-D2) and the thickness of the gapless layer (e.g., 110-D1) may be set so that when the shell is in use (e.g., shielding antenna 20), a cross-section (e.g., CS-D) of the radome shell 110D, in a direction of the antenna's transmission or reception (e.g., 21-D1) may include a section of dielectric material that may have a width that may be substantially (e.g., within a predetermined range, such as 5 percent or less) equal to an integer product of the effective half wavelength of the antenna's RF working frequency through the shell $\lambda_3/2$.

In other words, the layers of dielectric material (e.g., 110-D1, 110-D2) may be configured so as to produce an equivalent half wavelength (EHW) radome shell, in a sense that the combined effect of passage of RF radiation through the layers of dielectric material (e.g., propagation through layers 110-D1 and 110-D2, marked as $\lambda_3/2$) on the phase of the RF radiation may be substantially equivalent to, for example:

- propagation of RF radiation through an integer (e.g., 1, 2, 3 . . . ) product of half wavelengths in a uniform, single layer dielectric shell, as depicted in FIG. 3A and marked $\lambda_1/2$;
- propagation of RF radiation through an integer product of half wavelengths in a non-uniform, gapped layer of dielectric material, as depicted in FIG. 3C and marked $\lambda_2/2$; and/or
- any combination of the above.

It is noted herein that the combination of gapped and non-gapped layers, and selection of gap parameters, may provide, to a person skilled in the art, a degree of freedom in designing (e.g., by an iterative numerical simulation, as explained herein) a radome shell, to accommodate structural (e.g., physical rigidity) and RF radiation (e.g., equivalent half-wavelength, allowing optimal transparency) requirements. For example, as a geometric value (e.g., volume) of gaps in the elementary unit is increased, the EHW of the radome shell may also increase, allowing a designer of a half-wavelength radome shell to use a thinner gapless layer, while maintaining structural rigidity.

Embodiments of the present invention may provide an optimal combination or tradeoff between a first requirement for a transparency coefficient (e.g., a minimal value of a transparency coefficient) and a second requirement for a rigidity coefficient value (e.g., a minimal value of a rigidity coefficient).

For example, as depicted in FIG. 3D, the combined structure of layers 110-D1 and 110-D2 of radome shell 100D may provide a minimal (e.g., single) half-wavelength equivalent passage of RF energy through the dielectric shielding media of the radome shell. Consequently, radome shell 110D may have a transparency coefficient that may be substantially equal (e.g., within a predefined percentage) to a commercially available radome shell having a single half-wavelength wide shell (e.g., 100A depicted in FIG. 3A). In addition, the overall width of radome shell 100D may surpass that of commercially available, single half-wavelength radome shell 100A, and may thus have an improved (e.g., a higher) value of rigidity coefficient In some embodiments, at least one parameter of the gaps (e.g., a depth of the gaps) may be set to compensate for the non-tangent factor of the direction of reception or transmission of the RF energy. For example, as the direction becomes increasingly non-tangent and the course of propagation of RF energy through the shell increases (e.g., 21-D2 in relation to 21-D1), the depth of gaps may become respectively deeper, thus decreasing the equivalent dielectric coefficient and increasing the equivalent half-wavelength, to match the increased course of propagation of RF energy through the shell.

In other words, at least one of width, length, depth and spatial frequency of the repetitive gaps of a non-uniform radome shell (e.g., 100D) may be set according to the antenna's RF working frequency (e.g., by an iterative numerical simulation, as explained herein), so that the transparency coefficient of radome shell 100D at the antenna's RF working frequency and at the direction of the antenna's reception or transmission (e.g., along lines 21-D1 and 21-D2) may be substantially equal to or higher than the transparency coefficient of a comparable, standard (e.g., commercially available) second radome shell (e.g., 100A) having a uniform, single half-wavelength thick dielectric layer (e.g., 110-A).

As explained herein, the non-uniform radome shell (e.g., 100D) depicted in FIG. 3D may be configured according to a predefined tradeoff between different requirements (e.g., between a first requirement for a minimal rigidity coefficient and a second requirement for a minimal transparency coefficient). For example, at least one non-uniform layer (e.g., 110-D2) of the non uniform radome shell 110D may include a plurality of repetitive gaps that may be formatted or arranged in a first orientation or position, and a second non-uniform layer of the non uniform radome shell 110D may include a second plurality of repetitive gaps that may be formatted or arranged in a second orientation or position, to form a lattice, that may enable permeation of RF energy there through. The combined thickness of the first and second layer may surpass the thickness of a standard, commercially available, single half-wavelength layer radome shell (e.g., 100A), and the lattice structure may be rigid enough to comply with the requirement for minimal rigidity.

In other words, at least one of width, length, depth, orientation and spatial frequency of the repetitive gaps of radome shell 100D may be determined based on at least one of the amount and distribution of dielectric material in radome shell 100D (e.g., by an iterative numerical simulation, as explained herein), so that radome shell 100D may have a rigidity coefficient (e.g., resistance offered by the radome shell to deformation) that may be higher than a rigidity coefficient of a second, comparable radome shell 100A, where radome shell 100A has the same size and shape as radome shell 100D, may include a single, gapless layer of the same dielectric material, and where the single gapless layer of radome shell 100A has a thickness equal to half the wavelength of the antenna's RF working frequency (e.g., $\lambda_1/2$).

For example, as the gaps are widened, the equivalent dielectric coefficient is 'diluted' by the increased gap volume (having a dielectric coefficient of air), and the overall transparency coefficient of the gapped layer is increased. On the other hand, as the gap volume increases, the rigidity coefficient of the structured gapped layer is reduced, due to the diminished amount of material included in the gapped layer.

As explained herein, the rigidity coefficient of gapped layers may be a complex function of properties of the dielectric material and the gap parameters, and may be calculated numerically, using commercially available, structural simulation tools, as known in the art. In some embodiments, a value of one or more gap parameters (e.g., width, length, depth, orientation and spatial frequency) may be set by an iterative process of numerically calculating the rigidity coefficient, and modifying the value of the one or more gap parameters until a rigidity-related requirement (e.g., a requirement for minimal rigidity) is met or accommodated.

Similarly, the transparency coefficient of gapped layers may also be a complex function of properties of the dielectric material and the gap parameters, and may also be calculated numerically, using commercially available RF simulation tools, as known in the art. In some embodiments, a value of one or more gap parameters (e.g., width, length, depth, orientation and spatial frequency) may be set by an iterative process of numerically calculating the transparency coefficient, and modifying the value of the one or more gap parameters until a transparency-related requirement (e.g., a requirement for minimal transparency at a given RF frequency) is met or accommodated.

In another embodiment, as depicted in FIG. 3E, a non-uniform radome shell implementation (e.g., 100E) may include at least one gapless layer of dielectric material (e.g., 110-E1) having a width that may be equal to the half-wavelength width ($\lambda_1/2$) of the working RF frequency, and one or more second gapped layers (e.g., 110-E2, 110-E3).

The thickness of the gapless layer may be set so that a cross-section (e.g., CS-E) of the radome shell in a direction of the antenna's transmission or reception (e.g., along line 21-E1) may include a section of dielectric material that may have a width that is substantially (e.g., within a range of 5 percent or less) equal to half the wavelength of the antenna's RF working frequency (e.g., between 0.95 and 1.05 of $\lambda_1/2$), and may thus be optimally transparent at the antenna's working frequency.

Layers 110-E2 and 110-E3 may be added to provide additional physical rigidity to the radome shell (e.g., in implementations where gapless layer ($\lambda_1/2$) is too thin).

One or more gap parameters of gapped layers 110-E2 and 110-E3 may be set (e.g., by an iterative numerical simulation, as explained herein) so that the rigidity of the one or more gapped layers 110-E2 and 110-E3 and gapless layer 110-E1 may meet or accommodate a requirement for a minimal rigidity coefficient.

One or more gap parameters of gapped layers 110-E2 and 110-E3 may be set (e.g., by an iterative numerical simulation, as explained herein) so that the equivalent transparency of layers 110-D2 and 110-D3 may not significantly (e.g., within a predefined tolerance percentage) affect the overall transparency of the radome shell 110E, to accommodate a requirement for a minimal transparency coefficient at the antenna's RF working frequency.

Figure 4:
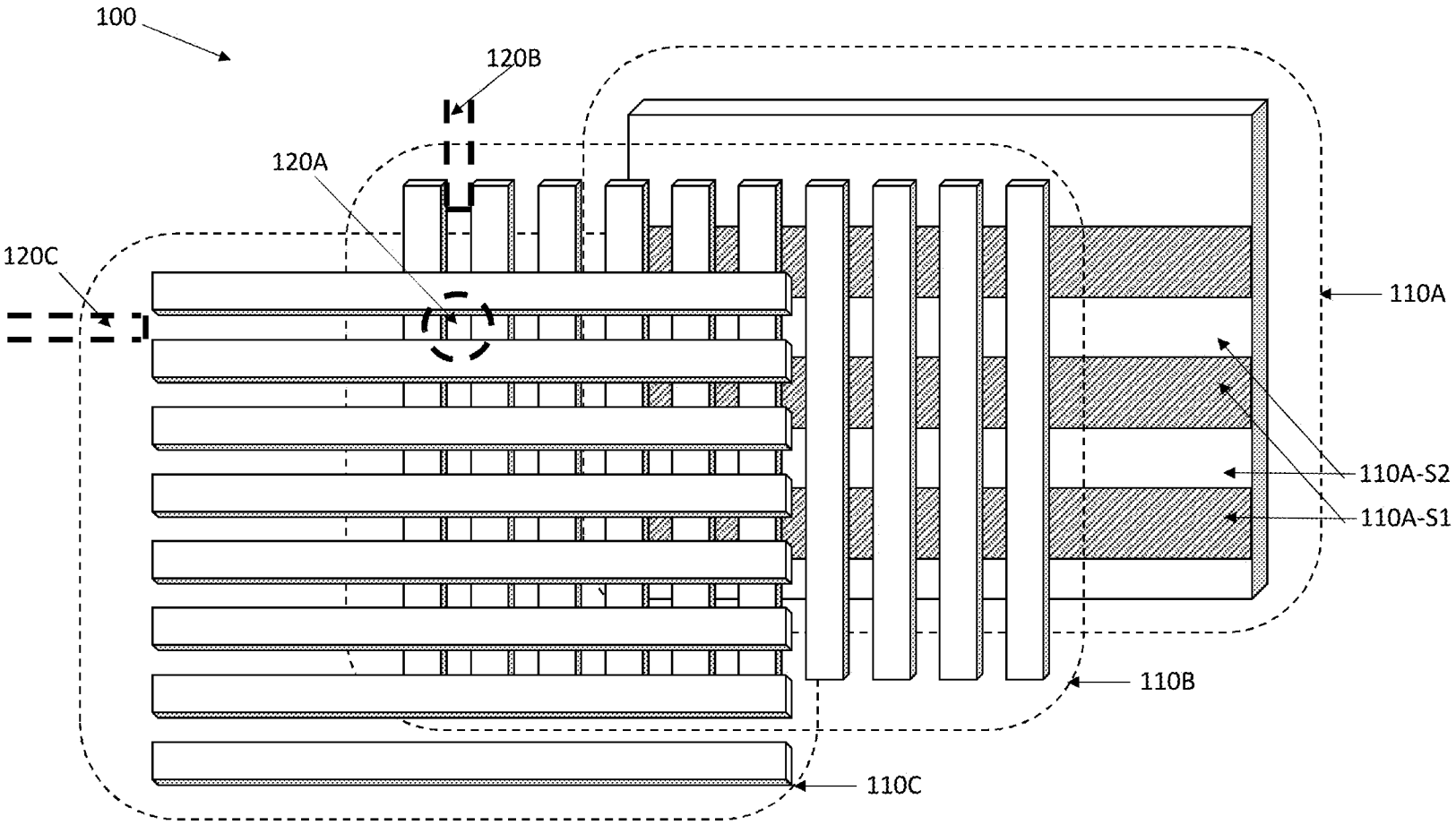
FIG. 4 is a diagram depicting a portion of a radome shell for shielding a radio-frequency (RF) antenna, the shell having a non-uniform structure, according to some embodiments of the invention.

Reference is now made to FIG. 4, which depicts a portion of radome shell 100 for shielding a radio frequency (RF) antenna, the shell having a non-uniform structure according to some embodiments of the invention. As shown in FIG. 4, radome shell 100 may include one or more layers 110 (e.g., 110A, 110B) of dielectric material.

According to some embodiments, at least one layer of dielectric material (e.g., 110B) may include a plurality of repetitive gaps, and at least one layer (e.g., 110A) of dielectric material may be or may include a portion that may be devoid of gaps (e.g., a gapless layer) and may be adapted to shield the antenna 20 from natural elements (e.g., against sunlight, wind, moisture, heat, etc.).

According to some embodiments, the gapless layer may include or may be manufactured from a single dielectric material. Alternately, at least one gapless layer (e.g. layer 110A) may include two or more dielectric materials. For example, gapless layer 110A may include one or more first sections (e.g., 110A-S1) of a first material, having a first dielectric coefficient, and one or more second sections (e.g., 110A-S2) of a second material, having a second dielectric coefficient.

Gapless layer 110A may be manufactured as a thin layer (e.g., in relation to a typical wavelength of the application's RF frequency range) of dielectric material, as explained in the background section. In contrast to common practice as known in the art, where considerations of structural rigidity may present a constraint of a minimal thickness of gapless layer 110A (especially where the antenna's working frequency is high), embodiments of the present invention may alleviate this constraint due to additional structural support that may be provided to shell 100, for example by the one or more gapped layers (e.g., 110B, 110C), while maintaining, complying with or accommodating at least one radome requirement (e.g., a first requirement for structural rigidity, and a second requirement for a minimal level of RF transparency).

According to some embodiments, radome shell 100 may include two or more layers (e.g., 110B, 110C) of dielectric material, having a plurality of repetitive gaps 120. The two or more layers may have at least one different parameter of repetitive gaps (e.g., a gap parameter); the value of the parameter may differ or be the same between the different layers. The gap parameter may be selected from a list that may include one or more of: a dimension (e.g., length, width and depth) of the repetitive gaps 120, a spatial frequency (e.g., a frequency of spatial repetition) of the repetitive gaps 120 and an orientation (e.g., along a spatial vector or axis) of the repetitive gaps 120.

For example, and as shown in FIG. 4, at least one first layer (e.g., 110C) may include a first plurality of repetitive gaps (e.g., 120C). The first plurality of repetitive gaps may be elongated, and oriented along a first axis. Additionally, or alternately, at least one layer (e.g., 110B) may include a second plurality of repetitive gaps (e.g., 120B). The second plurality of repetitive gaps may be elongated and oriented along a second axis.

In some embodiments, and as shown in FIG. 4, the first axis (e.g., of gaps in the first layer) and the second axis (e.g., of gaps in the second layer) may be non-parallel. In alternate embodiments, the first axis and the second axis may be spatially parallel.

As explained in relation to FIG. 2, gaps 120 may be implemented as openings, running through the complete thickness of a layer, or as recesses within a portion of a layer's thickness (if "gaps" are recesses there may be no break or hole in the material at the gap). Accordingly, at least one gap 120A may be implemented as an intersection between different types of gaps (e.g., a complete opening, a recess and a complete, gapless portion of the shell) of different layers. In the example shown in FIG. 4, at least one gap 120A may be formed as an intersection of a first elongated gap (e.g., a horizontal gap, such as 120C) in a first layer 110 (e.g., layer 110C) and a second gap (e.g., a vertical gap, such as 120B) in a second layer (e.g., layer 110B).

The formation of gaps in layers of radome shell 100 (e.g., gap 120C in layer 110C and gap 120B in layer 110B) and/or among layers (e.g., gap 120A among layers 110C and 110B), and selection of optimal radome parameters and gap parameters may facilitate obtaining a "sweet spot" in the tradeoff between the radome shell's transparency and its physical qualities, such as the rigidity of the radome's structure and the protection it provides to the antenna.

In some embodiments, one or more of the radome parameters and gap parameters maybe global, in a sense that they may be applied to or have the same value at the entire radome shell. Alternately, one or more of the radome parameters and gap parameters maybe local, in a sense that they may be applied differently to or have a different value at a first section or location of radome shell 100 and a second section or location of radome shell 100.

Different considerations for selection of radome parameters and gap parameters according to specific radome requirements (e.g., by an iterative numerical simulation process, as explained herein), and the effect of radome parameters on properties of the radome are explained herein.

For example, the radome's parameters may include:

- a required structural rigidity parameter;
- a transparency coefficient of the radome shell (e.g., a percentage of received and/or transmitted RF energy that may permeate radome shell 100);
- a dispersion coefficient of radome shell 100 (e.g., a percentage of received and/or transmitted RF energy that may be dispersed by a non-homogeneity in radome shell 100); and
- a reflection coefficient of radome shell 100.

Embodiments of the present invention may include selection of radome parameters and gap parameters to accommodate at least one radome requirement (e.g., a maximal permitted reflection) per at least one radome parameter (e.g., reflection coefficient), as explained herein.

Furthermore, as known in the art, one or more radome parameters (e.g., transparency coefficient, dispersion coefficient, reflection coefficient) may be dependent on properties of RF energy including for example, the antenna's working RF frequency, surrounding RF energy, RF energy polarization, RF phase, etc. Embodiments of the present invention may include selection of radome parameters and gap parameters that may accommodate or comply with at least one radome requirement according to at least one property of RF energy (e.g., by an iterative numerical simulation, as explained herein). For example, at least one radome parameter and/or gap parameter may be set or selected to accommodate a requirement for high transparency to a first RF transmission (e.g., having a first frequency and/or polarization) and low transparency to a second RF transmission (e.g., having a second frequency and/or polarization).

The required structural rigidity parameter (e.g., in Pascal units), may be dependent on a specific application and/or installation of the radome. For example, a radome installation in a location that may be exposed to strong wind may require increased rigidity. In some embodiments, a dielectric material of the one or more layers of dielectric material may be selected based on the dielectric coefficient of the dielectric material, to accommodate at least one requirement of the radome (e.g., a requirement for a minimal structural rigidity). For example, when the design of the radome requires a thin shell structure, a first dielectric material having a first inherent stiffness coefficient may be preferred over a second, smaller dielectric material having a second inherent stiffness coefficient. The dielectric coefficient of the preferred material may, in turn, be considered (e.g., during a numerical simulation process, as described herein) to accommodate at least one transparency requirement (e.g., a requirement for minimal transparency) of the radome shell.

The transparency coefficient of radome shell 100 may be a function of the type and amount of material shielding the RF antenna, and of the gap parameters of the repetitive gaps, and may affect radome shell's 100 transparency to RF energy.

For example, a first material having a high inherent dielectric coefficient may decrease radome shell's 100 transparency coefficient, whereas a second material having a low inherent dielectric coefficient may increase radome shell's 100 transparency coefficient. In some embodiments, a dielectric material of the one or more layers of dielectric material may be selected based on the dielectric coefficient of the dielectric material, to accommodate at least one requirement of the radome (e.g., a requirement for a minimal transparency coefficient).

In another example, assume a first layer (e.g., 110B) that may include a first plurality of repetitive gaps 120, located at a first spatial frequency and a second layer (e.g., 110C) that may include a second plurality of repetitive gaps 120, located at a second spatial frequency. Also assume the first spatial frequency is higher than the second spatial frequency. Accordingly, the first layer (e.g., 110B) may include less dielectric material than the second layer (e.g., 110C) and may thus have a higher transparency coefficient. Embodiments may include selecting one of gapped layers (e.g., 110B or 110C) having desired gap parameters and a gapless layer (e.g., 110A) so as to accommodate a combination of radome requirements for structural rigidity and RF transparency.

In a third example, assume a first layer 110 that may include a first plurality of repetitive gaps 120, having a first dimension (e.g., width, length, depth) and a second layer 110 that may include a second plurality of repetitive gaps 120, having a respective second dimension (e.g., width, length, depth). Also assume the first dimension is larger than the second dimension. Accordingly, the first layer 110 may include bigger gaps, and hence less dielectric material than the second layer. The first layer 110 may thus have a higher transparency coefficient, and a lower rigidity coefficient. Embodiments may include selecting one of gapped layers (e.g., 110B or 110C) having desired gap parameters and a gapless layer (e.g., 110A) so as to accommodate a combination of radome requirements for structural rigidity and RF transparency.

In a fourth example, a first radome shell 100 may include a first number of layers of dielectric material, and a second radome shell 100 may include a second number of layers of dielectric material. The first number of layers of dielectric material may be smaller than the second number of layers. Accordingly, the first radome shell 100 may include less dielectric material than the second radome shell 100 and may thus have a higher transparency coefficient, and a lower rigidity coefficient.

In a fifth example, a transparency of a non-uniform radome shell to the antenna's working RF frequency may be optimized by setting a combined thickness of a cross-section of dielectric material among two or more dielectric layers to be equal to half the wavelength of the working RF frequency, as explained above in relation to FIG. 3C.

In a sixth example, at least one of a width or length of one or more gaps of the repetitive gaps may be selected according to the wavelength required RF frequency. For example, as known in the art, the size of at least one of a width or length of the gaps may be set to be equal to or larger than the wavelength of the working RF frequency, to enable transmission of RF energy through the radome at the working RF frequency.

Given the six examples above, a person skilled in the art of RF engineering may design a non-uniform radome shell that may be configured to accommodate one or more requirements of transparency to RF energy of one or more RF frequencies.

For example, assume that a radome is required (e.g., by a designer or engineer) to pass RF energy within a predefined RF band. The radome shell may thus be is associated with at least one of:

- a first transparency requirement for a minimal transparency coefficient relating to a first RF frequency; and
- a second transparency requirement for a maximal transparency coefficient relating to a second RF frequency.

Pertaining to the examples brought above, of gap parameters and radome parameters that may affect the transparency of the radome shell to RF energy of specific RF frequencies, at least one of the gap parameters' values (e.g., width, length and/or depth of the repetitive gaps and spatial frequency of the repetitive gaps) and radome parameters' values (e.g., number, thickness and dielectric coefficient of dielectric material) may be set so as to accommodate at least one of the first transparency requirement and second transparency requirement.

In another example, assume that a radome is required (e.g., by a designer or engineer) to pass RF energy within a first predefined RF band at a first location (e.g., pertaining to a first direction from the antenna) and to pass RF energy within a second predefined RF band at a second location (e.g., pertaining to a second direction from the antenna). The radome shell may thus be is associated with at least one of:

- a first transparency requirement for a minimal transparency coefficient relating to a first portion of the first radome shell;
- a second transparency requirement for a minimal transparency coefficient relating to a second portion of the first radome shell;
- a third transparency requirement for a maximal transparency coefficient relating to a third portion of the first radome shell; and
- a fourth transparency requirement for a maximal transparency coefficient relating to a fourth portion of the first radome shell.

Pertaining to the examples brought above, of gap parameters and radome parameters that may affect the transparency of the radome shell to RF energy of specific RF frequencies, at least one of the gap parameters' values (e.g., width, length and/or depth of the repetitive gaps and spatial frequency of the repetitive gaps) and radome parameters' values (e.g., number, thickness and dielectric coefficient of dielectric material) may be set so as to accommodate at least one of the first, second, third and fourth transparency requirements.

As known in the art, the radome shell's 100 dispersion coefficient may be a function of at least one of:

- the working frequency of the RF antenna;
- an inherent function the dielectric material; and
- a function of the structure of the radome's shell 100.

For example, a dielectric material of one or more layers of dielectric material may be selected to accommodate at least one requirement of the radome, such as a requirement for minimal dispersion.

In another example, at least one gap 120 parameter (e.g., a gap size, a gap orientation and/or a spatial frequency of the location of the plurality of gaps) may be selected to accommodate at least one requirement of the radome, such as a requirement for minimal dispersion, in respect with the antenna's working RF frequency.

As known in the art, radome shell's 100 reflection coefficient may be a function of at least one of:

- the working frequency of the RF antenna;
- an inherent function the dielectric material; and
- a function of the structure of the radome's shell 100.

For example, the thickness of at least one layer (e.g., a gapless layer such as 110A) may be selected to accommodate at least one requirement of the radome, such as a requirement for minimal reflection of RF energy. As explained herein, such a requirement may dictate, that the at least one layer (e.g., gapless layer 110A) would be thin. This is particularly relevant for high working RF frequencies. The thinness of the at least one layer may affect the structural rigidity of the radome. Embodiments of the invention may include one or more gapped layers that may support the radome 100 shell's structure and may thus overcome this thickness impediment.

According to some embodiments, the radome shell may be associated with at least one requirement, including for example a requirement for radome shell 100 rigidity, transparency, dispersion, reflection and/or any combination thereof. At least one gap parameter of the repetitive gaps may be set or selected to accommodate the at least one radome requirement. The at least one parameter of the repetitive gaps may be selected from a list that may include, for example: a dimension (e.g., width, length and depth) of one or more of the repetitive gaps, an orientation of the repetitive gaps and a spatial frequency of the repetitive gaps.

For example, the dimension of the repetitive gaps, and their frequency of spatial repetition may affect the amount of material in a gapped layer (e.g., layer 110B), and may thus affect the rigidity of the gapped layer (e.g., the less material—the less rigid the shell may become).

In other words, the non-uniform radome shell 100 may be associated with a requirement for a minimal physical rigidity coefficient value. At least one parameter of the repetitive gaps 120 may be set so as to accommodate the requirement of minimal physical rigidity coefficient value. The parameter may be selected from a list consisting of: dimensions (e.g., width, length and depth of the repetitive gaps), an orientation of the repetitive gaps (e.g., when forming a lattice structure) and a spatial frequency of the repetitive gaps.

In another example, one or more gap parameters (e.g., a dimension of the repetitive gaps, and their frequency of spatial repetition) may affect the amount of material in a gapped layer (e.g., layer 110B), and may thus affect the transparency of radome shell 100. Moreover, a value of one or more gap parameters may be set so as to obtain a required specificity of the radome shell to transparency of RF energy in a specific frequency. For example, the less material, the more transparent the shell may become to permeation of RF energy. In another example, different RF frequencies may exhibit different transparency coefficients in response to a specific dimension (e.g., a specific width and/or length) of a gap. In another example, a transparency coefficient may be optimized by setting the gaps so that a cross-section of the radome shell may have a thickness that is equal to an integer product of half the working wavelength of the antenna, as explained above in relation to FIG. 3C.

Therefore, at least one of the dimensions (e.g., width, depth and length) of the repetitive gaps and their spatial frequency may be set so as to optimize a specificity of transparency of the shell to specific RF frequency and/or filter-out RF energy in unwanted frequency bands.

In other words, at least one of the width, depth and length of the repetitive gaps may be set according to the antenna's working RF frequency, so that the specificity of the a non-uniform radome shell (e.g., element 100D of FIG. 3D) to the antenna's 20 working RF frequency is higher than the specificity of the second radome shell to the antenna's working RF frequency. The term specificity may be used in the context of a specific, first RF frequency to refer to a relation (e.g. in db.) between a first transparency coefficient of RF energy in the first (e.g., desired) RF frequency and a second transparency coefficient of RF energy in a second (e.g., undesired) RF frequency.

In another example, at least one of an orientation of the repetitive gaps 120 and/or an ordering (e.g., placement of layers one after another in the direction of RF transmission and/or reception) of gapped layers (e.g., gapped layers 110B, 110C) may affect the transparency of the radome structure. For example, as known in the art, RF transceivers (e.g., satellite transceivers) may use a first RF channel having a first polarization vector for transmission and a second RF channel having a second polarization vector for reception. The orientation of the repetitive gaps in gapped layers (e.g., 110B, 110C) and/or ordering of the gapped layers (e.g., 110B, 110C) may be selected or set to be aligned with a first vector of polarization of RF energy and/or misaligned with a second vector of polarization of RF energy. Such alignment or misalignment may be utilized, for example, to obtain separation between transmission and/or reception (e.g., by antenna 20A) of signals of RF energy that may be polarized according to the first or second polarization vectors.

Such separation of RF energy according to RF polarization vectors has been demonstrated by experiments that have been conducted on implementations of embodiments of the present invention, having different orientation of repetitive gaps 120 and/or ordering of gapped layers (e.g., 110B, 110C).

In other words, the orientation of the repetitive gaps may be set according to a desired RF energy polarization, so that the specificity of the non-uniform radome shell (e.g., element 100D of FIG. 3D) to RF energy polarization may be higher than the specificity of a second (e.g., a standard, single half-wavelength radome shell of the same dielectric material (e.g., element 100A depicted in FIG. 3A) to the antenna's RF energy polarization. The term specificity may be used in the context of a specific, first polarization vector to refer to a relation (e.g. in db.) between a first transparency coefficient of RF energy in the first (e.g., desired) polarization vector and a second transparency coefficient of RF energy in a second (e.g., undesired) polarization vector (e.g., one of a different transmission channel, as known in the field of satellite communication).

Given the example above, a person skilled in the art of RF engineering may design a non-uniform radome shell that may be configured to accommodate one or more requirements of transparency to RF energy of a specific polarity.

For example, assume that a radome shell is required (e.g., by a designer or an engineer) to be transparent to RF energy at a specific polarization. The radome shell may thus be associated with at least one of:

- a first polarity requirement for a minimal transparency coefficient relating to a first polarity of RF energy; and
- a second polarity requirement for a maximal transparency coefficient relating to a second polarity of RF energy.

The orientation of the repetitive gaps may be set so as to accommodate at least one of the first polarity requirement and second polarity requirement.

In another example, assume that a non-uniform radome shell is required (e.g., by a designer or an engineer) to be transparent to a first polarization at a first location or portion of the shell (e.g., pertaining to a first antenna) and to be transparent to a second polarization at a second location or portion of the shell (e.g., pertaining to a second antenna) the radome shell may thus be associated with at least one of:

- a first polarity requirement for a minimal transparency coefficient relating to the first polarity of RF energy and to the first portion of the radome shell;
- a second polarity requirement for a maximal transparency coefficient relating to the second polarity of RF energy and to the first portion of the radome shell;
- a third polarity requirement for a minimal transparency coefficient relating to the second polarity of RF energy and to the second portion of the first radome shell; and
- a fourth polarity requirement for a maximal transparency coefficient relating to the second polarity of RF energy and to the second portion of the radome shell.

The orientation of the repetitive gaps may be set so as to accommodate at least one of the first, second, third and fourth polarity requirements.

As known in the art, the dispersion of RF energy may be affected by the number of passages between different material media, and by physical dimensions that may be apparent in the media. In other words, at least one dimension (e.g., width, length and/or thickness) of repetitive gaps 120 in a gapped layer (e.g., layer 110B), and/or the frequency of spatial repetition of gaps 120 in gapped layer 110B may affect the layer's dispersion coefficient.

In some embodiments, at least one dimension of repetitive gaps 120 and/or a frequency of spatial repetition of gaps 120 in gapped layer 110B may be set or selected so as to filter received RF energy, for example by setting a high dispersion coefficient of RF energy in a first frequency that may be received by antenna 20, and/or setting a low dispersion coefficient of RF energy in a second frequency that may be received by antenna 20.

As explained herein, at least one requirement of the radome may be a global requirement (e.g., pertaining to the entire radome shell 100). Alternately, or additionally, at least one requirement of the radome may be a local requirement (e.g., pertaining to a location or portion of radome shell 100).

Embodiments of the present invention may include selection of at least one gap parameter (e.g., dimension, orientation and or spatial repetition of gaps in a layer) and/or at least one radome parameter (e.g., a type of dielectric material having a specific dielectric coefficient, a number of layers and/or the ordering of layers) to accommodate at least one local requirement of the radome, as explained herein.

In some embodiments, at least one dielectric layer (e.g., 110C) may include two or more sections or locations of repetitive gaps, each having a different local parameter of repetitive gaps (e.g., a local gap parameter), that may be selected from a list that may include one or more of: a dimension (e.g., length, width, depth) of the repetitive gaps, a spatial frequency of the repetitive gaps and an orientation of the repetitive gaps. The local gap parameter may be selected or set to accommodate at least one local radome requirement (e.g., a maximal dispersion coefficient, a minimal transparency coefficient, and the like) at a specific RF frequency and/or specific direction, as explained herein.

The one or more local requirement may be selected from a list that may include, for example: a requirement on the structural rigidity parameter of a first portion of radome shell 100; a requirement on the structural rigidity parameter of a second portion of radome shell 100; a requirement on the transparency coefficient of the first portion of radome shell 100; a requirement on the transparency coefficient of the second portion of radome shell 100; a requirement on the dispersion coefficient of the first portion of radome shell 100;

a requirement on the dispersion coefficient of the second portion of radome shell 100; a requirement on the reflection coefficient of the first portion of radome shell 100 and; a requirement on the reflection coefficient of the second portion of radome shell 100.

For example, referring back to FIG. 1B, which depicts a system that may include one or more radome-shielded antennae in a non-concentric configuration; a first antenna (e.g., 20B) may be configured to receive RF energy at a first RF frequency from a first direction and a second antenna (e.g., 20C) may be configured to receive RF energy at a second RF frequency from a second direction.

In this example, at least one gap parameter may be set differently on different portions of radome shell 100, so as to optimize the transparency of RF energy at a required frequency per each of the antennae (e.g., 20B and 20C). For example:

- a first spatial frequency of gap repetition may be set at a first portion of radome shell 100, that may be in the first direction, to maximize radome shell 100 transparency for the first RF frequency in the first direction; and
- a second spatial frequency of gap repetition may be set at a second portion of radome shell 100, that may be in the second direction, to maximize radome shell 100 transparency for the second RF frequency in the second direction.

Selection or setting of local gap parameters (e.g., one or more gap dimensions, gap orientation, etc.) to portions or locations of radome shell 100 (e.g., in different transmission directions), to accommodate local radome requirements may be substantially equivalent to application of global gap parameters (e.g., one or more gap dimensions, gap orientation, etc.), and will not be repeated here for the purpose of brevity.

Figure 5:
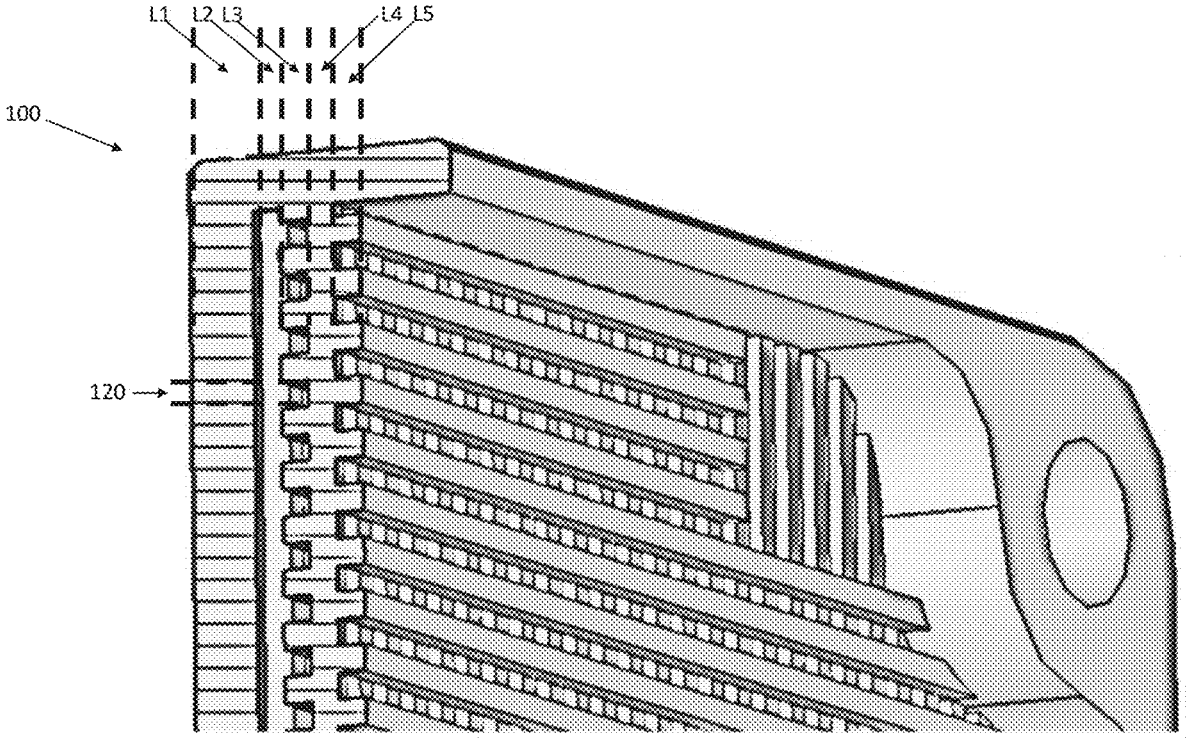
FIGS. 5 and 6 are diagrams depicting an example of an implementation of a radome shell having a non-uniform structure, according to some embodiments of the invention.
Figure 6:
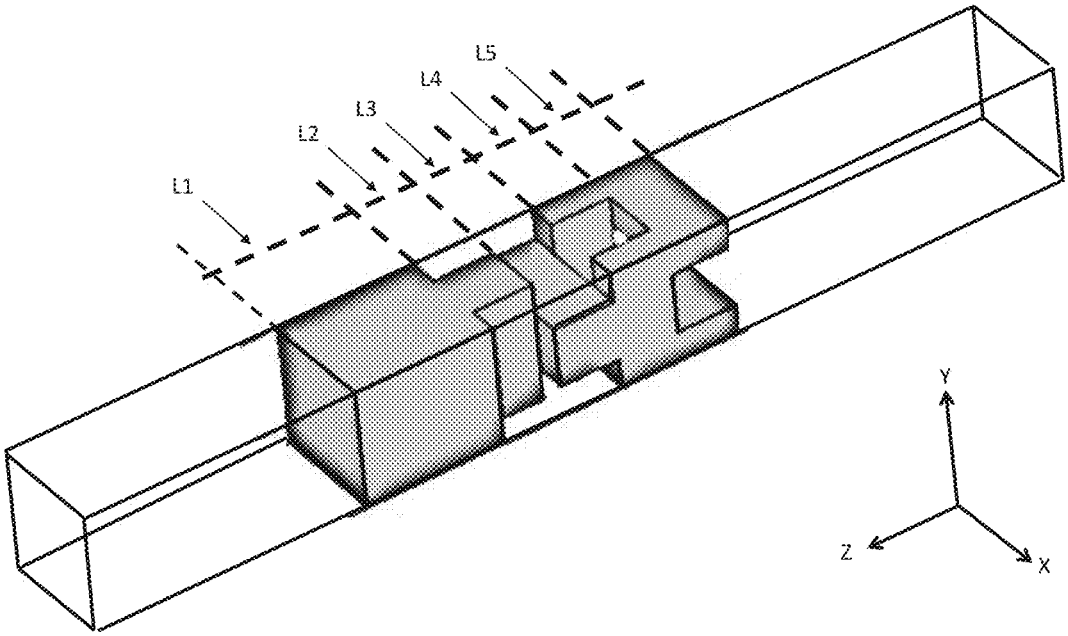

Reference is now made to FIGS. 5 and 6, which depict an example of an implementation of a radome shell having a non-uniform structure, according to some embodiments. FIG. 5 is an isometric view of a section of the radome shell. FIG. 6 is a close-up view of a volumetric section of the radome shell.

It is to be noted that the example depicted in FIG. 5 is of a radome shell having a planar form. However, this example should not be regarded as limiting in any way. For example, the radome shell may be formed in any geometrical shape, to obtain a required shape of a radome, including for example a spherical radome or a cylindrical radome, as depicted in FIG. 1.

As shown in FIG. 5, radome shell 100 may include one or more layers (e.g., L1) that are gapless, in a sense that they may include a continuous, spatially uninterrupted structure. Gapless layer may be manufactured from a dielectric material having a dielectric coefficient, and may be thin, in relation to the working RF wavelength. Gapless layer L1 may provide a shield, isolating an RF antenna (e.g., element 20 of FIG. 1) from harmful environmental elements (e.g., solar radiation, wind, humidity, temperature, etc.). Gapless layer L1 may be an external layer of radome shell 100, in a direction of an object (e.g., a target of a radar) that may be located beyond the shielding of radome shell 100, as known in the art.

Radome shell 100 may include one or more gapped layers (e.g., L2 through L4) that that may include a plurality of repetitive gaps 120. The plurality of repetitive gaps 120 may have one or more gap parameters (e.g., a dimension, a spatial repetition frequency, an orientation, etc.).

As elaborated herein, at least one dielectric material and at least one gap parameter may be set or selected, to accommodate at least one radome requirement that may be related to the antenna's RF performance (e.g., a required transparency to RF energy in a specific frequency and/or direction). Furthermore, at least one dielectric material and at least one gap parameter may be set or selected, to accommodate at least one radome requirement that may be related to the structural rigidity and/or isolating properties (e.g., temperature isolation) of the radome.

As shown in FIG. 6, radome shell 100 may receive RF energy from and/or transmit RF energy to an object that may be in the direction of gapless layer L1, e.g., in the direction of the Z axis.

In some embodiments of the invention, radome shell 100 may be manufactured, layer-by-layer by any appropriate method of manufacture, including for example 3D printing, substance deposition and/or substance etching, as known in the art.

For example, manufacture of radome shell 100 may include producing a first layer (e.g., gapless layer L1) of dielectric material (e.g., by casting, 3D printing and the like), and layering (e.g., by material deposition, 3D printing and the like) one or more second layers (e.g., L2 through L5) of dielectric material over the first layer, to form radome shell 100.

At least one of the first layer and one or more second layers may include a plurality of repetitive gaps. The plurality of repetitive gaps may be formed during the layering process (e.g., during 3D printing of the one or more layers) or by any appropriate process of manufacture, including for example an etching process (e.g., plasma etching, chemical etching and the like). As explained herein, at least one dimension of the gaps of the plurality of repetitive gaps may be of an order of magnitude of a working frequency wavelength of the RF antenna or one order of magnitude smaller than the working frequency wavelength of the RF antenna.

According to some embodiments, at least one of the width, length and spatial frequency of the repetitive gaps may be set according to at least one of the antenna's working RF frequency and direction of received or transmitted RF energy, so that the specificity of the non-uniform radome shell (e.g., as depicted in FIG. 3D) to the direction of the RF energy may be higher than the specificity of a standard (e.g., commercially available), single layer, half-wavelength thick radome shell (e.g., as depicted in FIG. 3A) to the direction of the RF energy. The term specificity may be used in the context of a specific, first direction to refer to a relation (e.g. in db.) between a first transparency coefficient of RF energy in the first (e.g., desired) direction and a second transparency coefficient of RF energy in a second (e.g., undesired) direction (e.g., one of side-lobes).

For example, at least one gap parameter (e.g., gap dimensions and/or spatial frequencies) may be of different values at different locations on the radome shell, so as to provide higher gain to RF energy coming from different directions.

Reference is now made to FIGS. 7A and 7B, which are isometric diagrams, respectively depicting a standard, one-layer radome portion, as known in the art and a non-uniform radome portion that may be included in an embodiment of the present invention. Reference is also made to FIGS. 8A and 8B which are data plots of experimental measurements, depicting the received RF power that was measured as a function of an antenna's working RF frequency and orientation, respectively relating to the standard, one-layer radome portion (e.g., such as element 100A of FIG. 3A), as known in the art and the non-uniform radome portion that may be included in an embodiment of the present invention.

It may be appreciated by a person skilled in the art, that although the standard radome shell (e.g., as depicted of FIG. 7A) and non-uniform radome shell (e.g., as depicted of FIG. 7B) are of substantially equivalent thickness (and thus of similar physical qualities, including the rigidity of the radome's structure and the protection it provides to the antenna), the performance of the non-uniform radome shell (e.g., as depicted on FIG. 8B) may be improved in relation to the performance of the standard radome (e.g., as depicted on FIG. 8A) as known in the art. For example, the non-uniform radome shell presents an improved peak gain, and a substantially lower side-lobe gain (e.g., around the 90 degrees orientation), in relation to the standard radome shell. These improvements may occur throughout the entire measured RF frequency range.

Embodiments of the invention may provide, to a designer of a radome shell, several degrees of freedom in the designing of the radome shell, so as to accommodate structural and RF radiation related requirements. Selection of a variety of parameter values (e.g., layer properties and gap properties) of a radome shell that may include one or more gapped and/or gapless layers as elaborated herein, may allow a person skilled in the art (e.g., by an iterative numerical simulation, as explained herein) to optimize a design of a radome shell as elaborated herein, to accommodate RF radiation requirements such as RF transparency, specificity to RF polarity, specificity to RF frequency, etc. and structural requirements, such as e.g., physical rigidity.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A radome shell for shielding a radio-frequency (RF) antenna, the radome shell comprising a plurality of layers of dielectric material, wherein at least one first layer is a gapped layer, comprising a plurality of repetitive gaps, and wherein at least one second layer of dielectric material is a gapless layer, and wherein at least one of width, length and depth of the repetitive gaps is of an order of magnitude of a working frequency wavelength of the RF antenna or one order of magnitude smaller than the working frequency wavelength of the RF antenna, wherein the depth of the repetitive gaps and the thickness of the at least one second layer are set so that when in use with the antenna, a cross-section of the radome shell in a direction of a transmission or reception of the antenna comprises a section of dielectric material that has a width substantially equal to an integer product of an equivalent half wavelength (EHW) of the RF working frequency of the antenna.

2. The radome shell of claim 1, wherein at least one of width, length, depth, orientation and spatial frequency of the repetitive gaps is determined based on at least one of the amount and distribution of dielectric material in the radome shell, so that the radome shell has a higher rigidity coefficient than a second radome shell having the same size and shape as the radome shell and comprising a single, gapless layer of the same dielectric material as the dielectric material forming the radome shell, and wherein the single gapless layer of the second radome shell has a thickness equal to half the wavelength of the RF working frequency of the antenna.

3. The radome shell of claim 2, wherein at least one of width, length, depth and spatial frequency of the repetitive gaps is set according to the RF working frequency of the antenna, so that a transparency coefficient of the radome shell at the RF working frequency of the antenna and at the direction of the reception or transmission of the antenna is substantially equal to or higher than the transparency coefficient of the second radome shell.

4. The radome shell of claim 2, wherein at least one of the width and length of the repetitive gaps is set according to the working RF frequency of the antenna, so that a specificity of the radome shell to the working RF frequency of the antenna is higher than the specificity of the second radome shell to the working RF frequency of the antenna.

5. The radome shell of claim 2, wherein at least one of the width, length and spatial frequency of the repetitive gaps is set according to the working RF frequency of the antenna, so that a specificity of the radome shell to the direction of the RF energy is higher than the specificity of the second radome shell to the direction of the RF energy.

6. The radome shell of claim 2, wherein the orientation of the repetitive gaps is set according to a polarization of RF energy, so that a specificity of the radome shell to the RF energy polarization is higher than the specificity of the second radome shell to the RF energy polarization.

7. A radome shell for shielding a radio-frequency (RF) antenna, the radome shell comprising a plurality of layers of dielectric material, wherein at least one first layer is a gapped layer, comprising a plurality of repetitive gaps, and wherein at least one second layer of dielectric material is a gapless layer, and wherein at least one of width, length and depth of the repetitive gaps is of an order of magnitude of a working frequency wavelength of the RF antenna or one order of magnitude smaller than the working frequency wavelength of the RF antenna, wherein the radome shell is associated with a requirement for minimal physical rigidity coefficient, and wherein at least one parameter of the repetitive gaps is set so as to accommodate the requirement of minimal physical rigidity coefficient, the parameter selected from a list consisting of: width, length and depth of the repetitive gaps, an orientation of the repetitive gaps and a spatial frequency of the repetitive gaps.

8. The radome shell of claim 7, wherein the radome shell is associated with at least one of:

a first transparency requirement for a minimal transparency coefficient relating to a first RF frequency; and a second transparency requirement for a maximal transparency coefficient relating to a second RF frequency, and wherein at least one of the width, length and spatial frequency of the repetitive gaps is set to accommodate at least one of the first transparency requirement and second transparency requirement.

9. The radome shell of claim 7, wherein the radome shell is associated with at least one of:

a first transparency requirement for a minimal transparency coefficient relating to a first portion of the radome shell;

a second transparency requirement for a minimal transparency coefficient relating to a second portion of the radome shell;

a third transparency requirement for a maximal transparency coefficient relating to a third portion of the radome shell; and a fourth transparency requirement for a maximal transparency coefficient relating to a fourth portion of the radome shell, and wherein at least one of the width, length and spatial frequency of the repetitive gaps is set to accommodate at least one of the first, second, third and fourth transparency requirements.

10. The radome shell of claim 7, wherein the radome shell is associated with at least one of:

a first polarity requirement for a minimal transparency coefficient relating to a first polarity of RF energy; and a second polarity requirement for a maximal transparency coefficient relating to a second polarity of RF energy, and wherein the orientation of the repetitive gaps is set to accommodate at least one of the first polarity requirement and second polarity requirement.

11. The radome shell of claim 7, wherein the radome shell is associated with at least one of:

a first polarity requirement for a minimal transparency coefficient relating to a first polarity of RF energy and to a first portion of the radome shell;

a second polarity requirement for a maximal transparency coefficient relating to a second polarity of RF energy and to the first portion of the radome shell a third polarity requirement for a minimal transparency coefficient relating to a second polarity of RF energy and to a second portion of the radome shell; and a fourth polarity requirement for a maximal transparency coefficient relating to the second polarity of RF energy and to the second portion of the radome shell, and wherein the orientation of the repetitive gaps is set to accommodate at least one of the first, second, third and fourth polarity requirements.

12. The radome shell of claim 7, wherein the gapless layer comprises one or more first section of a first material, having a first dielectric coefficient, and one or more second sections of a second material, having a second dielectric coefficient.

13. The radome shell of claim 7, comprising two or more layers of dielectric material, wherein the two or more layers have different dielectric coefficients.

14. The radome shell of claim 7, wherein at least one layer comprises two or more dielectric materials, having respective two or more different dielectric coefficients.

15. A radome shell for shielding a radio-frequency (RF) antenna, the radome shell comprising a plurality of layers of dielectric material, wherein two or more first layers are gapped layers, comprising a plurality of repetitive gaps, and wherein at least one second layer of dielectric material is a gapless layer, and wherein at least one of width, length and depth of the repetitive gaps is of an order of magnitude of a working frequency wavelength of the RF antenna or one order of magnitude smaller than the working frequency wavelength of the RF antenna, and wherein the two or more first layers have at least one different parameter of repetitive gaps, and wherein the parameter is selected from a list consisting of: a width of the repetitive gaps, a length of the repetitive gaps, a depth of the repetitive gaps, a spatial frequency of the repetitive gaps and an orientation of the repetitive gaps.

16. The radome shell of claim 15, wherein the at least one dielectric layer comprises two or more sections of repetitive gaps, having at least one different local parameter of repetitive gaps, selected from a list consisting of: a width of the repetitive gaps, a length of the repetitive gaps, a depth of the repetitive gaps, a spatial frequency of the repetitive gaps and an orientation of the repetitive gaps.

17. The radome shell of claim 15, wherein the at least one second layer comprises one or more first section of a first material, having a first dielectric coefficient, and one or more second sections of a second material, having a second dielectric coefficient.

18. The radome shell of claim 15, wherein two or more layers of the first layers and second layers have different dielectric coefficients.

19. The radome shell of claim 15, wherein at least one layer of the first layers and second layers comprises two or more dielectric materials, having respective two or more different dielectric coefficients.

* * * * *